United States Patent [19]

Pozsgay

[11] 4,002,048

[45] Jan. 11, 1977

[54] METHOD OF STRETCH REDUCING OF TUBULAR STOCK

[75] Inventor: Dezsoe Albert Pozsgay, Pittsburgh, Pa.

[73] Assignee: Aetna-Standard Engineering Company, Elwood City, Pa.

[22] Filed: Dec. 19, 1975

[21] Appl. No.: 642,663

[52] U.S. Cl. ..... 72/205; 72/234; 72/377

[51] Int. Cl.[2] ..... B21B 17/00

[58] Field of Search ..... 72/205, 234, 235, 366, 72/367, 377

[56] References Cited

UNITED STATES PATENTS

| | | | |
|---|---|---|---|
| 3,645,121 | 2/1972 | Pfeiffer et al. | 72/205 |
| 3,919,872 | 11/1975 | Demny et al. | 72/205 |

*Primary Examiner*—Milton S. Mehr
*Attorney, Agent, or Firm*—Mandeville and Schweitzer

[57] ABSTRACT

The disclosure relates to a new procedure for the stretch reducing of tubular stock, in a manner to reduce the so-called crop end loss off of specification product at the ends of a tube section. In the process of the invention, a multi-stand stretch reducing mill is provided with a plurality of speed variable mill stands, at least at the upstream or entry end of the multi-stand mill. As the head end of a finite tubing section enters the upstream end of the mill, and as the tail or trailing end of the finite section enters the mill, programmed speed variations are made in the selected mill stands, to compensate for the fact that the head end or tail end sections of a finite length of pipe are acted upon at any given instant by fewer mill stands than intermediate sections of the tube.

In the process of the invention, selected mill stands are speed controlled such that certain ones thereof apply maximum pulling force to the tube end section, while certain other mill stands apply maximum retarding force. At one or more intermediate mill stand locations, mill stand speed is controlled to establish a substantial equilibrium of such pulling and retarding forces. within this general procedure, a limiting condition at all times is that a predetermined stretch factor, for a given workpiece, is not exceeded at any mill stand. Realization of desired wall thickness, without either maximum force effectiveness or maximum stretch factor, can also be a limiting condition, particularly when rolling the tail end section. The procedure of the invention may require the selected upstream mill stands to be either speeded up, or slowed down, or sometimes both speeded up and slowed down at different moments, in relation to steady-state speed.

12 Claims, 22 Drawing Figures

| | | | |
|---|---|---|---|
| ROLL SPEED | 84.5% | 100% | 100% |
| PULL FACTOR | −.976 | +1.000 | |
| STRETCH FACTOR | .144 | .144 | |

METHOD OF STRETCH REDUCING OF TUBULAR STOCK

BACKGROUND AND SUMMARY OF THE INVENTION

In the production of seamless tubing, for example, a finite section of pierced tubing is processed in a stretch reducing rolling mill, in order to reduce the diameter of the tubing to a predetermined size. In a stretch reducing mill, the tubing is also elongated under tension during the rolling process, in order to control the wall thickness of the tubing. In a typical stretch reducing mill, there may be as many as 24 mill stands, for example, arranged in a close coupled sequence. The Gillet U.S. Pat. No. 3,355,923 is illustrative of the physical arrangement of a typical stretch reducing mill.

When a pierced tubular workpiece enters the successive passes of a stretch reducing mill, it is successively reduced in diameter. This of course results in elongation of the tubing, such that successive mill stands are driven at progressively higher speeds to accommodate the progressively lengthening work. In addition, in order to control the wall thickness of the tubing, it is desired to further elongate the tubing under tension between mill stands. The generalities of these procedures are, of course, well known in the industry.

As may be understood, a given intermediate area of a tubular workpiece passing through a multi-stand mill is influenced by all of the mill stands, both upstream and downstream from the mill stand through which the given area is passing. Thus, a section of tubing in the twelfth stand of a 24 stand mill is influenced by the relative retarding action of all of the upstream mill stands and the relative pulling action of all of the downstream mill stands, and this combined influence is reflected in processing of the tube at the twelfth mill stand. However, when the head end of the tubing first enters the mill, there can of course be no influence deriving from mill stands in the downstream portions of the mill at which the tubing has not yet arrived. Likewise, as the tail end of the tubing section passes through the mill, there is no influence derived from the empty upstream mill stands. As a result, the stretching effect achieved in the head end and tail end portions of a finite length of tubing is significantly less than in the central portion, tending to result in off-specification product in the head end and tail end areas.

Customarily, the off-specification end areas are cropped off and scrapped. As is readily apparent, the shorter the overall length of tubing, the greater is the percentage loss represented by the crop ends. Especially in connection with seamless tubing, where the tubing sections are relatively short in order to be driven over a piercing mandrel of acceptable length, the crop end losses can represent an undesirably high percentage of the overall tonnage.

The problem of overall tension control in the head end and tail end portions of rolled metal products has been recognized for some time, and various efforts have been made to effect a reduction in the crop losses of such products. Among such prior proposals is that of U.S. Pat. No. 3,645,121, in which progressive speed variation in successive mill stands is disclosed. However, the procedure of this patent is not workable in a practical way, and does not recognize the fundamental considerations involved. British Patent Specification No. 1,274,698, also discloses the generalities of a procedure for controlling the speed of stretch reducing mills to reduce head end and tail end crop losses. As in the case of the beforementioned United States Patent, however, the generalities of the disclosed process are crude and lack specificity, such that only limited advantages are realized. The Hayashi U.S. Pat. No. 3,874,211 utilizes a combination of tension and screw-down control to minimize crop end loss in tube rolling. Similar practices have been followed in the rolling of metal strip, as for example reflected in the Stoltz U.S. Pat. No. 2,281,083, and Stringer U.S. Pat. No. 3,110,203 where back tension and forward tension on the strip is controlled to reduce off-specification material at the head end and tail end of a finite strip. In the Wallace U.S. Pat. No. 2,972,268, a combination of screw-down and tension control is provided.

While the prior art adequately discloses the generality of tension control for minimizing head end and tail end crop loss, less than optimum effectiveness has been achieved in the end result. The procedures of the pesent invention serve to optimize head end and tail end rolling procedures, particularly for the stretch reducing rolling of tubing, to provide a greater yield of specification material over the length of the tubing blank as compared to prior art techniques for achieving crop loss reduction.

Pursuant to the invention, a multiple stand stretch reducing mill for seamless tubing and the like (e.g., electric weld or other tubing which is heated prior to stretch reducing) is controlled according to predetermined calculation for tubing of given physical and metallurgical characteristics, whereby the processing of the head end and tail end sections of the tubing can be carried out within specification over a greater length than has been practicable heretofore in commercial scale operations. The procedure of the invention involves in part the determination for a tubing section of given physical and metallurgical characteristics at a given mill stand, of the maximum driving forces that may be applied thereto by a given mill stand, without excessive slippage between the mill rolls and the workpiece. In addition, the process involves a determination for a tubing section of given size, wall thickness, metallurgical characteristics, temperature, etc. of a predetermined maximum stretch factor, beyond which detrimental yielding of the material might be experienced. These calculated parameters are applied to the operation of the mill stands in such a way that maximum driving forces may be applied to the end sections of the workpiece, for maximum elongation of the end sections, while at the same time the predetermined maximum stretch factor is not exceeded in any case.

In the processing of leading or head end portions of a tubular workpiece, the procedure of the invention involves the variable control of upstream mill stands, as the head end proceeds into the stretch reducing mill. Initially, the mill stands are operating at a predetermined, steady-state speed. As the head end enters, successive mill stands are decelerated according to a pre-calculated program, such that, whenever the head end is engaged in three or more mill stands, two of the mill stands are exerting maximum driving force, one in the pulling direction and one in the restraining direction, while an intermediate mill stand is driven to establish a predetermined equilibrium of pulling forces on either side of it. In any case where the exertion of maximum pulling and restraining forces be programmed mill stands is such as to tend to exceed the maximum stretch factor of the tubing in the intermediate tubing section, the mill speed program according to the invention provides for a plurality of intermediate mill stands, each programmed to exert less than maximum driving force on the tubing, and calculated to maintain substantial force equilibrium on opposite sides of each of the intermediate mill stands, and also serving to maintain the stretch factor in any area of the intermediate tubing section at or below the predetermined maximum stretch factor for the physical and metallurgical characteristics of the tubing at that stage of the process. The procedures of the invention recognize that the character of the workpiece is changing as it progresses through the mill, and the pre-calculated mill stand speeds are determined in such a manner that effective tensions applied to the head end and tail end sections of the tubing are limited primarily by the ability of the mill stands to apply driving force without excessive slippage, or by the limiting stretch factor.

Whereas prior art proposals for limiting crop end loss largely are concerned with the progressive acceleration or deceleration of successive mill stands for applying progressively increasing tensions, the procedures of the invention, recognizing the important basic parameters to be observed, achieve optimum reduction of crop end loss by mill speed control which is not necessarily progressive. Rather, more typically, there is a wave characteristic to mill speed control of the variable speed mill stands when following the procedures of the invention.

In a typical application of the process of the invention, a finite length of tubing is processed in a multi-stand stretch reducing mill, which may contain, for example, as many as twenty-four successive mill stands. Pursuant to the invention, while it is theoretically possible to provide individual, independently variable speed control for each of the twenty-four mill stands, in such a mill, there generally is little practical economical justification for providing independent variable control for that many mill stands. More typically, the objectives of the invention may be largely satisfied in a mill installation of reasonable cost, by providing for the necessary independent variable speed control in the first eight or ten mill stands.

For a more complete understanding of the procedures of the invention, reference should be made to the following detailed description of preferred embodiments thereof, in conjunction with the accompanying drawings.

DESCRIPTION OF PREFERRED EMBODIMENTS OF THE INVENTION

Figure 1:
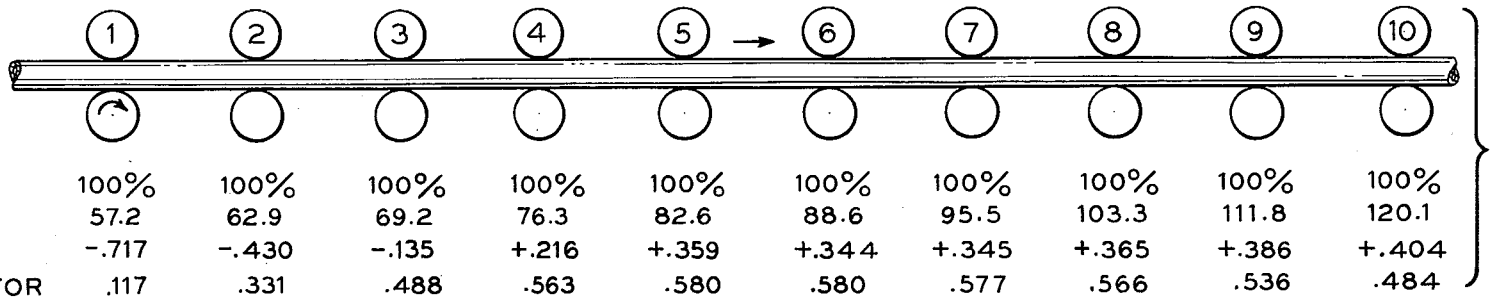
FIG. 1 is a highly simplified, schematic representation of a multi-stand stretch reducing mill, illustrating the first ten stands of the mill and indicating roll speeds and pertinent mill stand characteristics as in a steady-state condition.

Referring now to the drawings, and initially to FIG. 1, there is schematically represented the first ten mill stands at the upstream end of a multi-stretch reducing mill. The construction features of the mill form no part of the present invention and can be conventional. To advantage, however, the mill may be constructed generally in accordance with the disclosure of the co-pending William R. Scheib United States application Ser. No. 677,891, filed Apr. 19, 1976 for "Stretch Reducing Mill". Insofar as is pertinent to the present invention, it is merely necessary that a plurality of the mill stands at the upstream end of the mill be capable of variable speed operation and be provided with appropriate control means for effecting such speed variation. For the purposes of the present application, it is assumed that the overall mill comprises about 24 mill stands and that the first eight mill stands are capable of individually variable speed control for process purposes. The number of such individually controlled mill stands is not a critical feature of the invention. In general, ideal conditions would be achieved by providing individual control for all 24 mill stands, but the cost versus benefit ratios are generally satisfactory only at a much smaller number. An adequate balancing of cost and performance appears to have been achieved in one commercial mill by providing variable control in eight mill stands.

Pursuant to known practices, a multi-stand stretch reducing mill, when operated in a "steady-state" condition (i.e., only the center portion of the tube is in the mill), is driven so that each successive mill stand has a higher peripheral roll speed. This takes into account that the tubing blank is becoming elongated as it is reduced in diameter.

In FIG. 1, in the several columns of figures underlying each of the numbered mill stands 1–10, there is a typical set of mill operating conditions for steady-state operation of a stretch reducing mill rolling a heavy wall tubing of initial O.D. of about 4.75 inches and initial wall thickness of 0.648 inches. The indicated tubing section has a maximum stretch factor of about 0.58. By following the "RPM" line from left to right in FIG. 1, it will be seen that the RPM of the mill stands is steadily increasing in the downstream direction. The desired steady-state operation, which takes into account normal elongation of the tubing and also imparts a desired amount of stretch tension thereto, is designated on the "Roll Speed" line as 100% of the steady-state speed.

In the steady-state condition of the mill, it can be noted that the "Pull Factor" for the first three mill stands is negative, meaning that these mill stands are exerting a restraining influence on the tubing, whereas the positive Pull Factor for the downstream stands indicates that those mill stands are tending to advance the tubing in the forward or left-to-right direction. For definitional purposes, a Pull Factor of 1.000 indicates that the rolls of a mill stand are applying maximum driving force to the tubing, either in the pulling (+1.000) or restraining (−1.000) direction. Thus, it will be seen that, in the steady-state condition, the Pull Factors in the various upstream mill stands are well below maximum driving force. The lowermost line of numbers in FIG. 1 reflects the Stretch Factor applied to the tubing in the vicinity of the mill stand. The Stretch Factor represents the ratio of the actual stress applied to the tubing in an axial direction to the yield stress of the material. The maximum Stretch Factor desired to be applied is a variable depending upon the size of the tubing, wall thickness, metallurgical characteristics, etc. and is established in advance on an empirical basis. In the illustration of FIG. 1, the maximum desired Stretch Factor is about 0.58, and the operation of the mill stands is predetermined so that the indicated Stretch Factor is not exceeded.

As will be readily understood, any given section of tubing in the mill, under steady-state conditions, is influenced by all of the mill stands upstream and all of the mill stands downstream thereof. When processing finite lengths, however, the head end and tail end portions of the tubing are differently influenced, since there are no effective mill stands downstream of the head end or upstream of the tail end. Accordingly, in operating a stretch reducing mill to minimize head end and tail end crop losses, certain of the mill stands are temporarily driven on a non-steady-state basis, in an effort to somewhat approximate the conditions "seen" by a section of tubing in the steady-state operation.

According to one of the significant aspects of the invention, the rolling of the head end section of a tubular workpiece is carried out by, in general, exerting maximum driving forces on the head end section, consistent with not exceeding the indicated stretch factor for the material. Thus, as the head end enters the mill and travels through successive mill stands, the speeds of the active mill stands are varied, either by increasing or decreasing roll speed from the steady-state condition and, in many cases, varying the mill stand speed both above and below steady-state conditions.

By way of example, and with reference to FIGS. 2–8 and 16–19 of the drawings, there is illustrated a sequence of mill stand speed control according to the invention as the head end of a tube enters and proceeds into a stretch reducing mill. The sequence of illustrations is typical for the tubing for which FIG. 1 represents a steady-state rolling condition.

Figure 2:
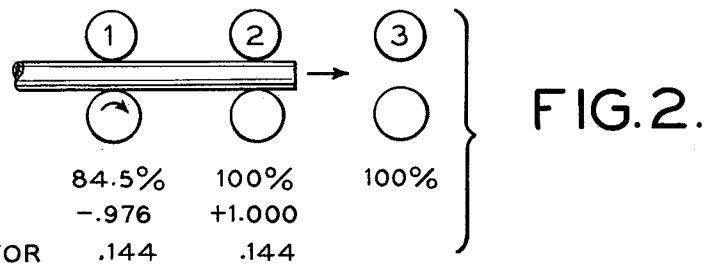
FIGS. 2–8 are sequential views of the stretch reducing mill of FIG. 1, reflecting schematically the manner of controlling the speeds of successive mill stands a the head end of a workpiece enters the mill and progresses through the individual variable mill stands.

As reflected in FIG. 2, as the head end of the tubing enters mill stand No. 2, the speed of mill stand No. 1 is rapidly decelerated to apply maximum or near maximum retarding force to the tubing at that station. In the specific illustration, the roll speed is decelerated to approximately 84.5 percent of steady-state speed, resulting in a Pull Factor of −0.976. The Pull Factor at mill stand No. 2 is +1.000. The Stretch Factor at this stage is well below the maximum value of 0.650 for the indicated class of tubing, because of the inability of the two mill stands to exert sufficient force effectiveness upon the tubing in the absence of significant slippage.

Figure 3:
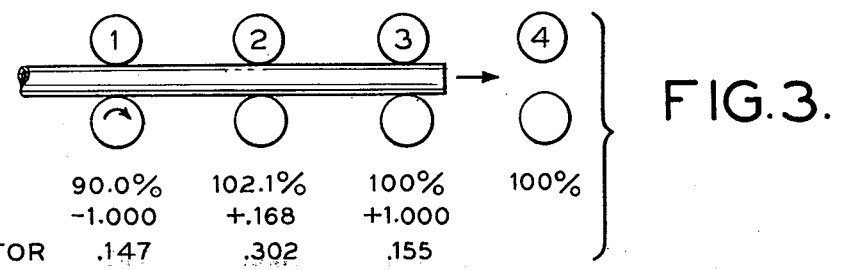
Figure 4:
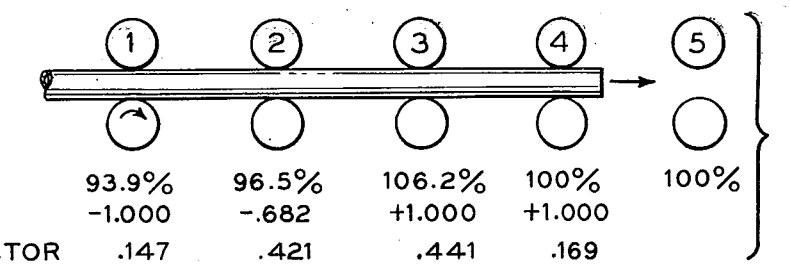
Figure 5:
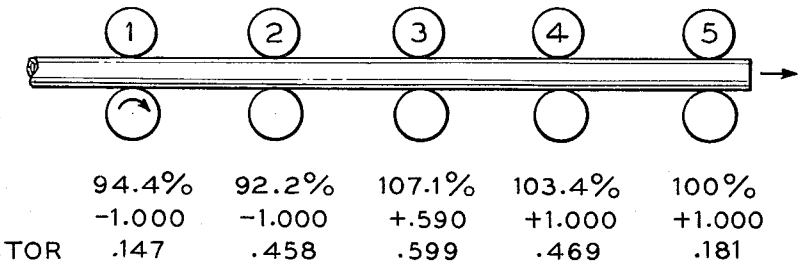

As the tubing proceeds to mill stand No. 3, as reflected in FIG. 3, the speed of mill stand No. 1 must be increased (to about 90.0 percent of steady-state speed) in order to avoid significant slippage, as a Pull Factor of −1.000 is achieved even at the higher speed. The speed of the third mill stand remains at 100 percent of steady-state, while the speed of the second mill stand is slightly increased, to 102.1 percent of steady-state speed, in order to achieve a desirable balance of pulling and retarding forces.

As the tubing proceeds into the fourth mill stand, the speeds of mill stands No. 1, 2 and 3 are variably controlled in order to achieve a Pull Factor of +1.000 at mill stands 3 and 4, a Pull Factor of −1.000 at mill stand No. 1, while the speed of mill stand No. 2 is controlled to achieve a balance of the pulling and retarding forces acting upon the tubing. In this respect, in both FIGS. 3 and 4, although more than three mill stands are simultaneously active on the tubing, only one intermediate mill stand is controlled to achieve a balance of pulling and retarding forces, inasmuch as the predetermined maximum stretch factor is not being reached at any mill stand. Likewise, when the tubing enters mill stand No. 5, as reflected in FIG. 5, only a single mill stand (No. 3) is controlled to achieve a balance of pulling and retarding forces, while mill stands No. 1 and 2 are operated to achieve a Pull Factor of −1.000, and mill stands No. 4 and 5 are operated to achieve a Pull Factor of +1.000. Only a single "balancing" mill stand is required, because the maximum Stretch Factor of 0.650 is not yet reached in the intermediate portion of the tubing.

Figure 6:
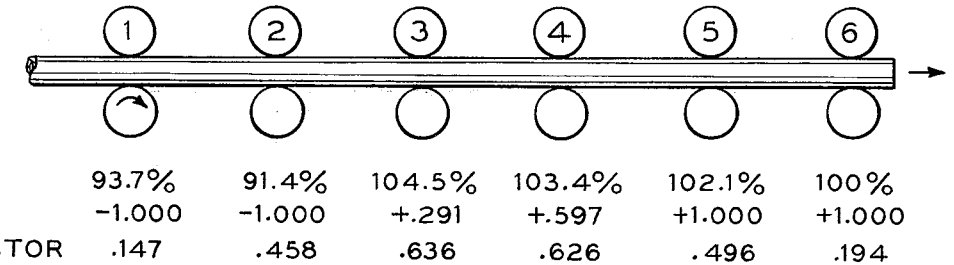

Upon the tubing entering the sixth mill stand, the use of a single intermediate mill stand for achieving balance of pulling forces would cause the maximum Stretch Factor to be exceeded. Accordingly, in the illustrated sequence, with six mill stands in active operation, the first two mill stands are driven to achieve a Pull Factor of −1.000, the fifth and sixth mill stands are driven to achieve a Pull Factor of +1.000, and a balance of pulling and retarding forces is derived by the control of two intermediate mill stands, No. 3 and 4. In the illustration of FIG. 6, mill stands No. 3 and 4 are driven at 104.5 percent and 103.4 percent respectively of steady-state speed, achieving a Pull Factor of +0.291 in mill stand No. 3 and of +0.597 in mill stand No. 4, with Stretch Factors of 0.636 and 0.626 in the respective mill stands, slightly under the desired maximum.

Figure 7:
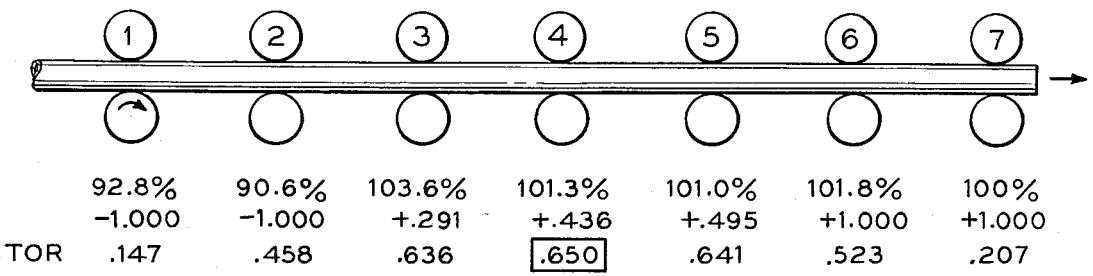
Figure 8:
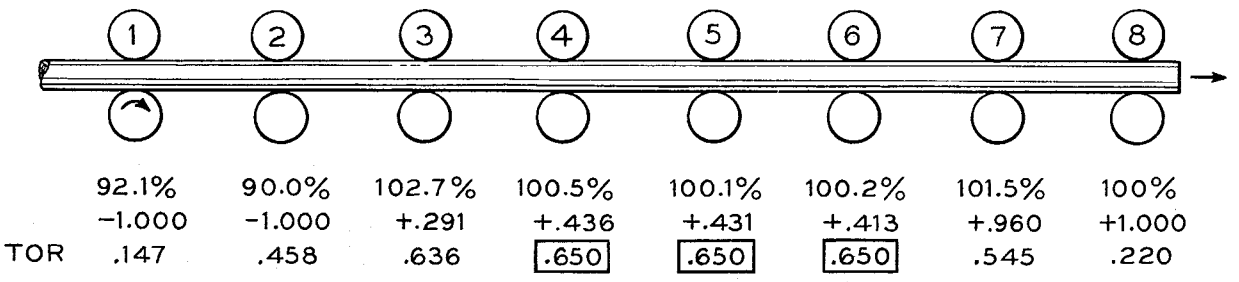

As the tubing proceeds deeper into the mill, entering mill stands No. 7 and 8, as reflected in FIGS. 7 and 8 respectively, additional intermediate mill stands are required to be speed controlled to achieve less than maximum force effectiveness, in order to provide a balance of pulling and retarding forces without exceeding the maximum Stretch Factor. Thus, as reflected in FIGS. 7 and 8, the first two and last two mill stands provide maximum or near maximum retarding and pulling forces respectively, whereas all of the intermediate mill stands (3, 4 and 5 in the case of FIG. 7 and 3–6 in the case of FIG. 8), are driven to achieve a balance of forces throughout the length of the tubing while at the same time not exceeding the desired Stretch Factor. Thus, the basic parameters of the head end rolling process become apparent. First, when more than three mill stands are acting on the tubing, at least one of them is controlled in a manner to provide a balance of the pulling and retarding forces, while the others are driven to provide maximum pulling and retarding forces, as long as the maximum Stretch Factor is not exceeded. Whenever the combined effect of the pulling and retarding forces is sufficient to exceed the desired maximum Stretch Factor, additional intermediate mill stands are controlled to distribute the balancing forces over a sufficient number of mill stands so that the maximum Stretch Factor is not exceeded at any of them.

For the particular class of tubing processed in the illustration of FIGS. 1–8, generally the first two and last two mill stands can be driven to achieve maximum retarding and pulling forces, whereas all of the intermediate mill stands are required to be driven at speeds resulting in considerably less than maximum pulling effectiveness to avoid exceeding the desired Stretch Factor.

The illustrations of FIGS. 16–19 reflect a sequence of operating speeds of the first three mill stands as a function of the location of the head end extremity as it enters and passes downstream through the mill. Thus, in the case of FIG. 16, the speed of the first mill stand, when the front of the tube enters that mill stand, is shown to be 57.2 rpm, which is the steady-state speed reflected in FIG. 1. As the head end reaches mill stand No. 2, the speed of mill stand No. 1 is rapidly decelerated down to about 48.3 rpm. Thereafter, as the head end proceeds down through to mill stand No. 9, the speed of mill stand No. 1 is first gradually accelerated, up to a speed of about 54 rpm when the head end is in mill stand No. 5, and then decelerated slightly to about 52.7 rpm when the head end reaches mill stand No. 8. In the illustrated procedure, only the first eight mill stands are variably speed controlled for head end rolling, so that the speed of mill stand No. 1 is accelerated back to the steady-state speed as the head end reaches mill stand No. 9.

Figure 17:
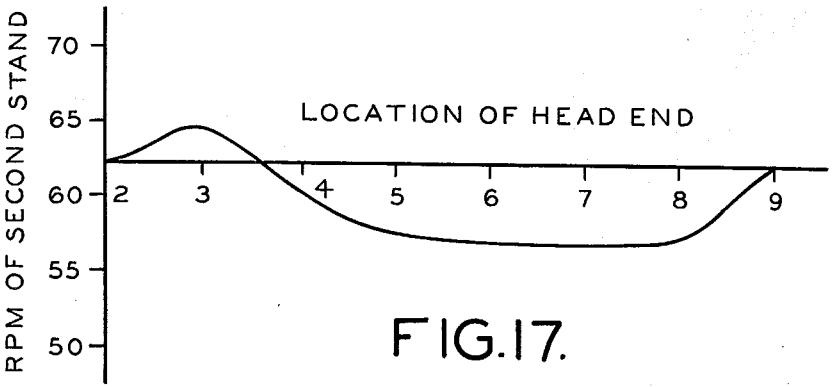

In FIG. 17, the curve reflects the speed in rpm of mill stand No. 2 as a function of the location of the head end of the tubing as it penetrates the mill. Initially, of course, the mill stand is operating at the steady-state speed of 62.2 rpm. As the tubing enters mill stand No. 3, mill stand No. 2 is accelerated to a speed of about 64.2 rpm, somewhat above the steady-state speed. Thereafter, as the tubing enters mill stand No. 4, mill stand No. 2 is decelerated to a speed of about 60.0 rpm, which is below steady-state speed. Mill stand No. 2 is further decelerated to a speed of around 57 rpm, until the head end approaches mill stand No. 9, at which time mill stand No. 2 is accelerated back to its steady-state speed.

Figure 18:
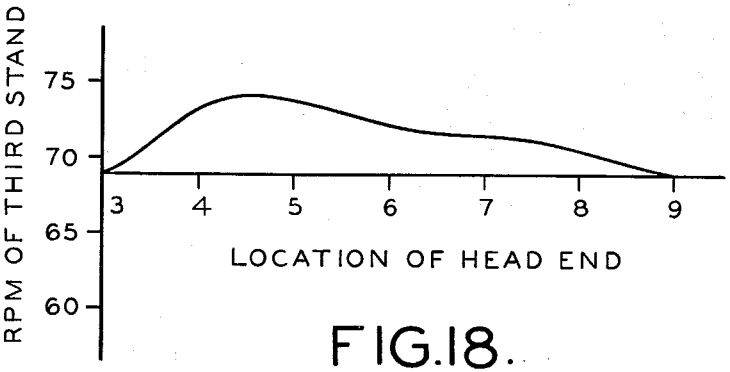
Figure 19:
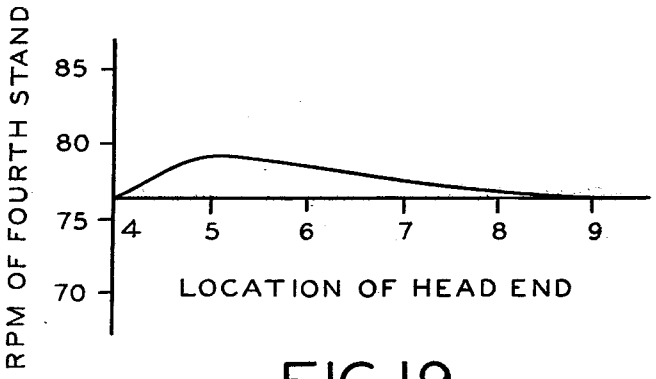

The speed variation of mill stand No. 3 is reflected in FIG. 18 as a function of the position of the front end of the tubing in traveling from mill stand No. 3 to mill stand No. 9. As indicated, the speed of mill stand No. 3 is sharply accelerated as the tubing approaches mill stands 4 and 5, and is thereafter gradually decelerated back to the steady-state speed. Speed variation of mill stand No. 4, reflected in FIG. 19, shows fairly rapid acceleration of roll speed, followed by gradual deceleration, as the head end proceeds through the mill.

As will be evident, the speed variation of the mill stands in order to achieve the objectives of the invention tends to be both fairly complex and nonlinear and may, as in the case of mill stand No. 2, involve both acceleration above and deceleration below steady-state speed.

With respect to rolling of the tail end section of a tubing, although the basic and fundamental principles remain essentially the same, the practical techniques necessarily are somewhat different than with respect to rolling of the head end section. In part, this reflects the fact, as the tail end enters the mill, all 24 (e.g.) of the mill stands are actively participating in the rolling operation. Further, whereas the head end section is gradually entering the variable speed section of the mill, the tail end section is progressively leaving that section.

Figure 20:
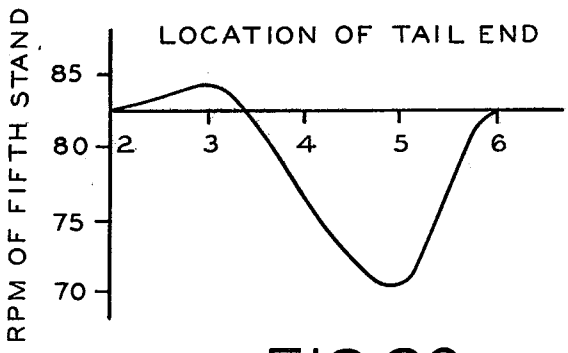
FIGS. 20–22 are similar graphic representations of the manner of controlling mill stand speed as a function of the location of the tail end of a workpiece as it progresses into the mill.
Figure 21:
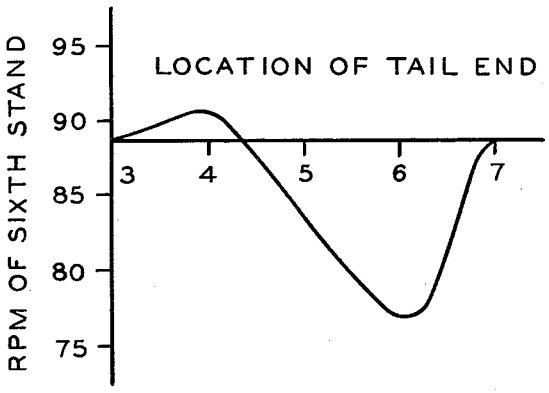
Figure 22:
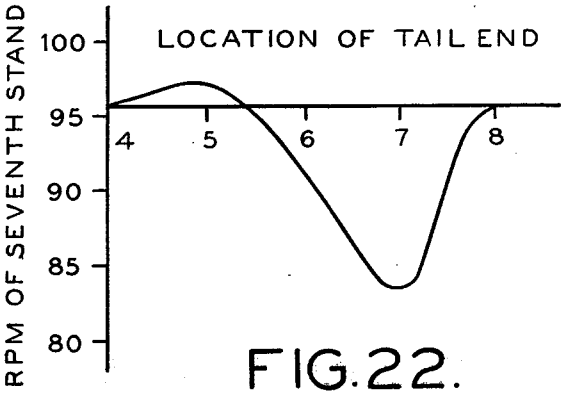

FIGS. 9–15 illustrate a typical procedure according to the invention for controlling the speeds of the upstream series of mill stands during the rolling of the tail end section, with the first ten mill stands participating in the variable speed operation at various moments. FIGS. 20–22 are graphic representations of the speed variation of mill stands No. 5, 6 and 7, as a function of the location of the tail end of the tubing, as it progresses downstream through the mill.

Figures 9, 10, 11, 12:
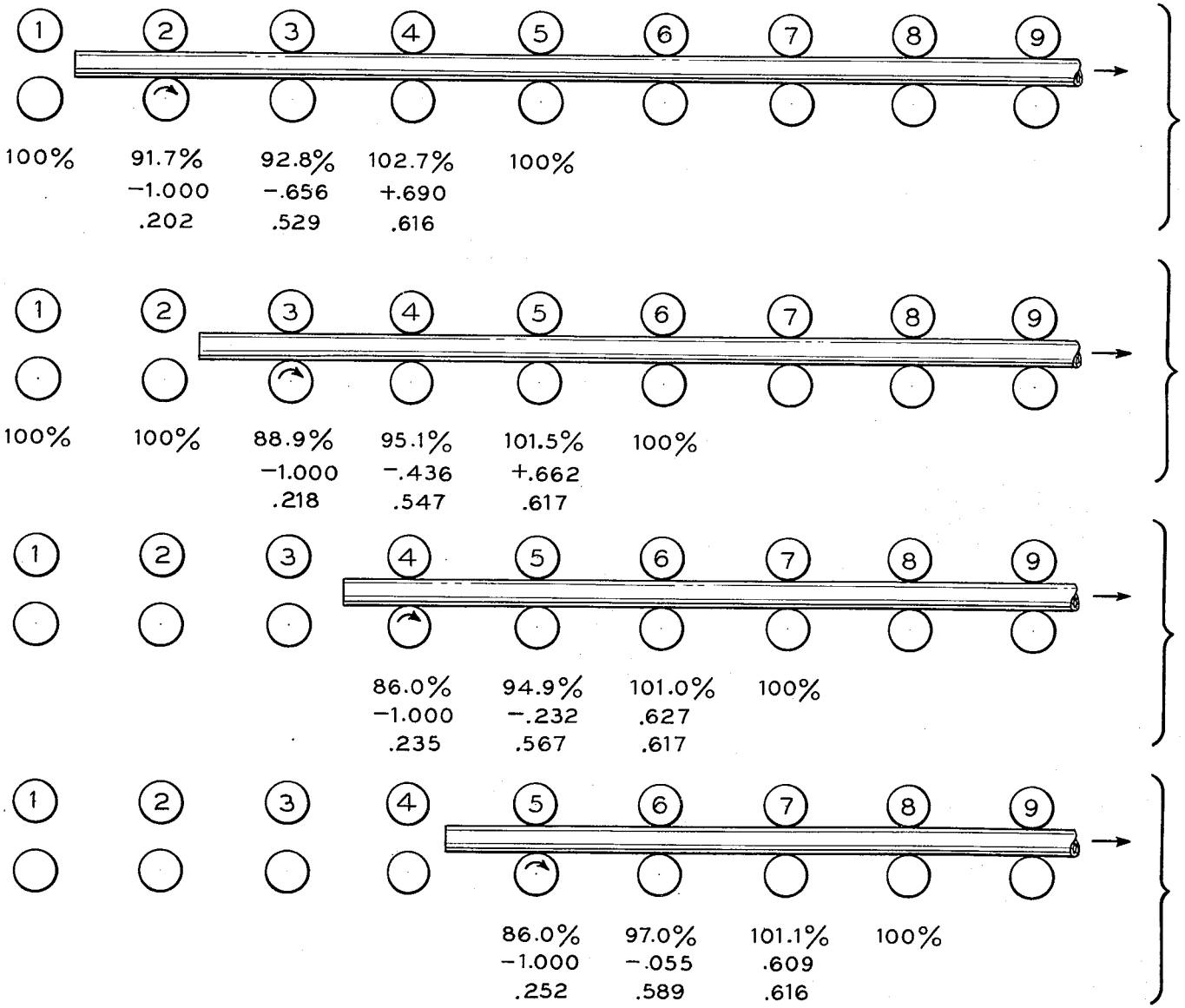
FIGS. 9–15 are similar sequential schematic views of the reducing mill of FIG. 1, reflecting the manner of controlling mill stand speed as the tail end of a workpiece progresses in succession through the variable speed section of the mill.

In FIG. 9, the tail end extremity has just left mill stand No. 1, causing the tail end rolling procedure to be initiated. Typically, this may be brought about by measuring the change in the load on mill stand No. 1. If desired, a sensing means may be provided slightly upstream of mill stand No. 1, to sense the approach of the tail end of the tubing and initiate the tail end rolling sequence while the tubing remains in mill stand No. 1.

In the illustrated tail end rolling sequence, a relatively small number of mill stands may be participating at any moment in the program of speed variation from steady-state condition. For the specific tubing example for which the procedures of FIGS. 1–22 are representative, it is adequate to utilize three consecutive mill stands in the speed variation program at any moment in the tail end rolling series. Thus, as will be observed in FIGS. 9–15, a steadily progressing series of three mill stands is either accelerated or decelerated from the steady-state speed, pursuant to the basic principles of the invention.

Figure 13:
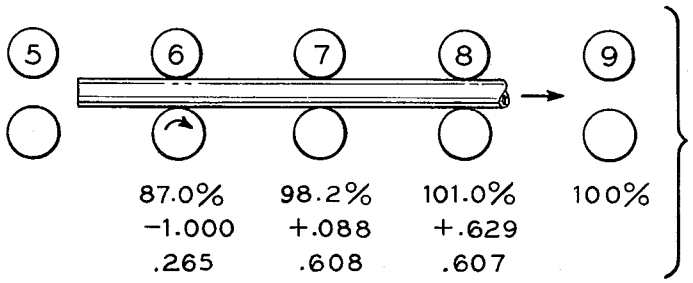
Figure 14:
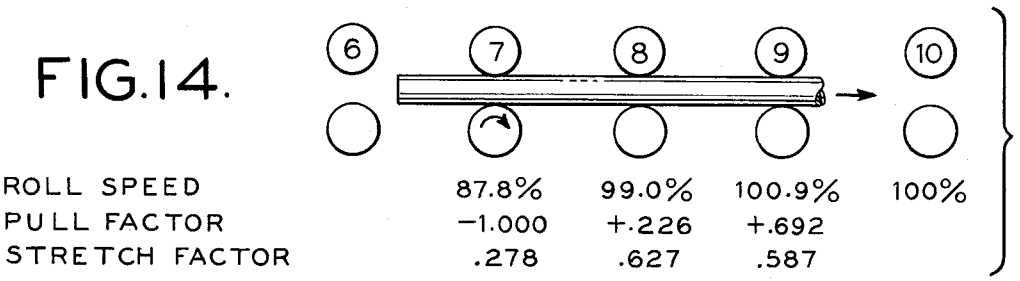
Figure 15:
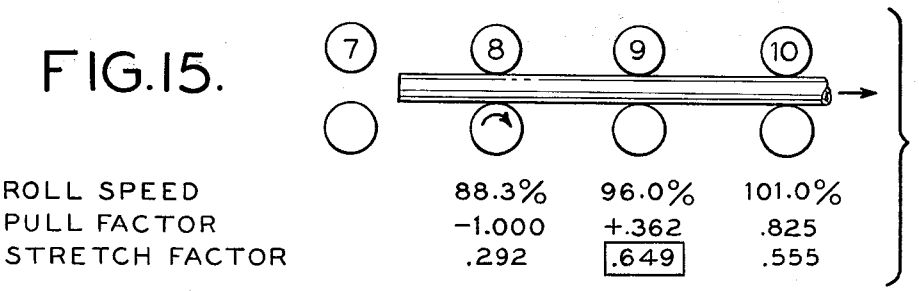
Figure 16:
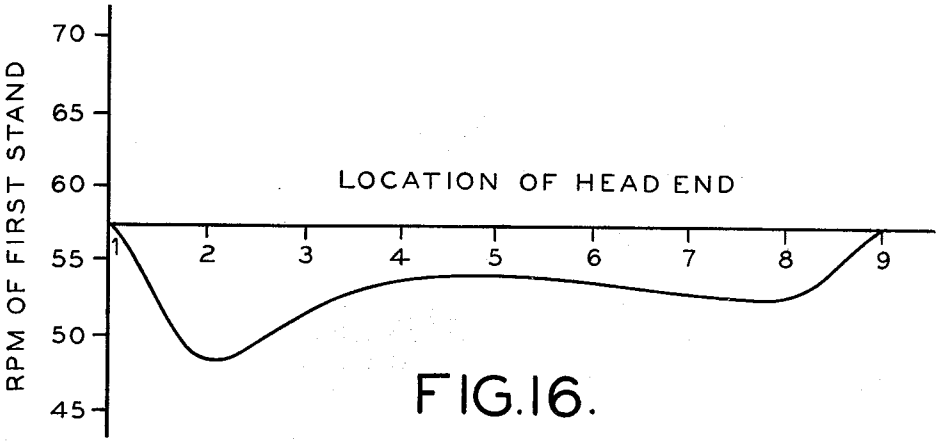
FIGS. 16–19 are graphic representations of the speed variation of individual mill stands as a function of the location of the head end of a workpiece progressing into the mill.

In all instances, the participating mill stand which is farthest upstream on the tubing is driven to achieve substantially maximum retarding force effectiveness (i.e., −1.000) on the tubing. The two mill stands next downstream are controlled to achieve a balance of the pulling forces acting on the tubing, without exceeding the desired maximum Stretch Factor or, as will appear, without reducing wall thickness below desired levels. In FIGS. 9–12, as the tail end extremity enters mill stands No. 2 through 5 respectively, the second mill stand acting on the tubing is driven to provide a negative Pulling Factor, whereas the corresponding mill stand in FIGS. 13–15 is driven to provide a positive Pull Factor in order to achieve the desired balance of pulling forces and retarding forces.

In carrying out the rolling sequence reflected in FIGS. 9–15, for the tail end section, the roll speed is in general first caused to increase somewhat above steady-state speed, as the tail end approaches but is still several mill stands away, and then to decelerate to a speed below the steady-state speed, as the tail end extremity arrives at the mill stand. The stand is reaccelerated to the steady-state speed after the tail end has passed through. Accordingly, the curve of roll speed versus tail end location, as shown in FIGS. 20–22 for mill stands 5, 6 and 7, is somewhat of a wave form. With respect to FIG. 20, for example, mill stand No. 5 is operating at the steady-state speed of 82.6 rpm, when the tail end is in mill stand No. 2. As the tail end proceeds into mill stand No. 3, mill stand No. 5 is accelerated somewhat to about 84.6 rpm. Then, as the tail end begins to approach mill stand No. 5, its speed is sharply decelerated, down to about 78.3 rpm, as the tail end comes into mill stand No. 4, and then down to 71.1 rpm, when the tail end finally arrives at mill stand No. 5. Thereafter, mill stand No. 5 is accelerated back to steady-state speed. FIGS. 21 and 22 reflect similar wave form speed curves.

The following examples reflect some typical tube rolling parameters, for rolling operations carried out according to the invention, it being understood that both the physical and metallurgical characteristics of the tubing will have a bearing on the specific control of the mill stands. These specific control parameters may be developed empirically, or in many cases calculated in advance, when following the basic underlying principles of the invention.

EXAMPLE I-A

Example I-A, below, is a schedule for the rolling of a light wall tubing, having a maximum Stretch Factor of 0.82.

The ninth column reflects the Stretch Factor at a given mill stand and at a given moment in the cycle. Column 10 indicates the velocity of the tubing leaving a given mill stand, and gives an indication of the constantly accelerating rate of speed of the tubing as it passes through the mill.

An examination of the data of Example I-A reflects that, as the head end extremity penetrates the mill and passes along to mill stand No. 8, the upstream mill stands are exerting maximum retarding force while downstream mill stands are exerting maximum pulling

EXAMPLE I-A

HEAD END ROLLING, LIGHT WALL TUBING
MAXIMUM STRETCH FACTOR = 0.82

| Head End At Stand NO. | Condition At Stand NO. | Average Tube O.D. (Inches) | Wall Thickness (Inches) | RPM | Delta RPM From Steady State | Total H.P. | Pull Factor | Stretch Factor | Velocity Leaving (FPM) |
|---|---|---|---|---|---|---|---|---|---|
| 1 | 1 | 4.631 | 0.156 | 105.73 | 0.00 | 15. | 0.228 | 0.0000 | 268. |
| 2 | 1 | 4.631 | 0.156 | 92.29 | −13.45 | −66. | −0.977 | 0.1255 | 280. |
| 2 | 2 | 4.372 | 0.160 | 117.07 | 0.00 | 124. | 1.000 | 0.1251 | 291. |
| 3 | 1 | 4.631 | 0.156 | 99.33 | −6.40 | −73. | −1.000 | 0.1277 | 303. |
| 3 | 2 | 4.372 | 0.158 | 121.85 | 4.78 | 33. | 0.161 | 0.2614 | 317. |
| 3 | 3 | 4.114 | 0.163 | 129.05 | 0.00 | 149. | 1.000 | 0.1336 | 330. |
| 4 | 1 | 4.631 | 0.156 | 106.09 | 0.35 | −79. | −1.000 | 0.1277 | 324. |
| 4 | 2 | 4.372 | 0.157 | 116.09 | −0.98 | −60. | −0.711 | 0.3730 | 340. |
| 4 | 3 | 4.114 | 0.160 | 140.36 | 11.31 | 125. | 1.000 | 0.3876 | 359. |
| 4 | 4 | 3.856 | 0.168 | 142.88 | 0.00 | 181. | 1.000 | 0.1440 | 375. |
| 5 | 1 | 4.631 | 0.156 | 108.47 | 2.74 | −81. | −1.000 | 0.1277 | 331. |
| 5 | 2 | 4.372 | 0.157 | 113.21 | −3.86 | −90. | −1.000 | 0.4051 | 348. |
| 5 | 3 | 4.114 | 0.157 | 142.93 | 13.87 | 54. | 0.503 | 0.5345 | 370. |
| 5 | 4 | 3.856 | 0.161 | 149.74 | 6.87 | 140. | 1.000 | 0.4097 | 393. |
| 5 | 5 | 3.606 | 0.172 | 152.96 | 0.00 | 206. | 1.000 | 0.1526 | 411. |
| 6 | 1 | 4.631 | 0.156 | 108.06 | 2.33 | −81. | −1.000 | 0.1277 | 330. |
| 6 | 2 | 4.372 | 0.157 | 112.78 | −4.28 | −90. | −1.000 | 0.4051 | 347. |
| 6 | 3 | 4.114 | 0.156 | 132.98 | 3.93 | −21. | −0.270 | 0.6166 | 371. |
| 6 | 4 | 3.856 | 0.157 | 152.01 | 9.14 | 95. | 1.000 | 0.6042 | 399. |
| 6 | 5 | 3.606 | 0.163 | 157.71 | 4.75 | 150. | 1.000 | 0.4304 | 424. |
| 6 | 6 | 3.372 | 0.176 | 161.55 | 0.00 | 227. | 1.000 | 0.1613 | 445. |
| 7 | 1 | 4.631 | 0.156 | 106.57 | 0.84 | −79. | −1.000 | 0.1277 | 325. |
| 7 | 2 | 4.372 | 0.157 | 111.23 | −5.84 | −89. | −1.000 | 0.4051 | 342. |
| 7 | 3 | 4.114 | 0.156 | 122.35 | −6.70 | −60. | −0.778 | 0.6593 | 367. |
| 7 | 4 | 3.856 | 0.154 | 152.07 | 9.20 | 59. | 1.000 | 0.7281 | 399. |
| 7 | 5 | 3.606 | 0.156 | 160.01 | 7.05 | 97. | 1.000 | 0.6273 | 430. |
| 7 | 6 | 3.372 | 0.164 | 166.61 | 5.06 | 159. | 1.000 | 0.4511 | 458. |
| 7 | 7 | 2.153 | 0.180 | 171.18 | 0.00 | 250. | 1.000 | 0.1701 | 481. |
| 8 | 1 | 4.631 | 0.156 | 104.28 | −1.45 | −78. | −1.000 | 0.1277 | 318. |
| 8 | 2 | 4.372 | 0.157 | 108.84 | −8.23 | −86. | −1.000 | 0.4051 | 335. |
| 8 | 3 | 4.114 | 0.156 | 115.72 | −13.33 | −73. | −1.000 | 0.6758 | 360. |
| 8 | 4 | 3.856 | 0.152 | 149.64 | 6.77 | 25. | 0.770 | 0.7930 | 393. |
| 8 | 5 | 3.606 | 0.151 | 159.72 | 6.76 | 58. | 1.000 | 0.7476 | 429. |
| 8 | 6 | 3.372 | 0.155 | 168.75 | 7.20 | 98. | 1.000 | 0.6500 | 464. |
| 8 | 7 | 3.153 | 0.165 | 176.38 | 5.19 | 167. | 1.000 | 0.4715 | 496. |
| 8 | 8 | 2.949 | 0.185 | 181.72 | 0.00 | 274. | 1.000 | 0.1789 | 521. |

In the Example, column No. 1 reflects the location at any time of the head end of the tubing as it penetrates the mill. Column No. 2 identifies a particular mill stand, and the condition at that mill stand at a given time may be determined by reading across the columns of data. The third and fourth columns reflect the average outside diameter and wall thickness of the tubing at a given time at a given mill stand. The fifth and sixth columns indicate, respectively, the speed of the mill stand in rpm, and the difference (if any) in rpm of the momentary roll speed as compared to the steady-state speed. The seventh and eighth columns indicate, respectively, horse power input at a given mill stand, and the Pull Factor, the latter being as a fraction of the maximum pulling (or retarding) force which can be imparted without significant slippage. A negative Pull Factor indicates a retarding force is being applied, and this is also reflected in a negative horsepower input.

force. In any case where more than three mill stands are engaging the tubing section, at least one of them is driven to provide less than maximum pulling or retarding force, in order to achieve a balance of the pulling and retarding forces acting on the tubing. In the illustration of Example I-A, the relatively high Stretch Factor of 0.82 is not closely approached until the head end extremity is in mill stand No. 8, the last mill stand involved in the variable speed sequence. Accordingly, in this Example, it is not necessary to involve more than one mill stand in the function of balancing of forces.

EXAMPLE I-B

Example I-B is a typical rolling schedule for the tail end section of the same tubing reflected in the schedule of Example I-A. In this instance, ten mill stands in all are involved in the variable speed schedule, although only three at a time.

EXAMPLE I-B

TAIL END ROLLING, LIGHT WALL TUBING
MAXIMUM STRETCH FACTOR = 0.82

| Tail End At Stand NO. | Condition At Stand NO. | Average Tube O.D. (Inches) | Wall Thickness (Inches) | RPM | Delta RPM From Steady State | Total H.P. | Pull Factor | Stretch Factor | Velocity Leaving (FPM) |
|---|---|---|---|---|---|---|---|---|---|
| 2 | 5 | 3.606 | 0.156 | 152.96 | — | — | — | — | — |
| 2 | 4 | 3.856 | 0.156 | 145.45 | 2.57 | 40. | 0.458 | 0.6460 | 387. |
| 2 | 3 | 4.114 | 0.158 | 115.63 | −13.43 | −87. | −1.000 | 0.5010 | 360. |
| 2 | 2 | 4.372 | 0.159 | 110.13 | −6.94 | −104. | −1.000 | 0.1748 | 339. |
| 3 | 6 | 3.372 | 0.154 | 161.55 | — | — | — | — | — |
| 3 | 5 | 3.606 | 0.155 | 155.09 | 2.13 | 63. | 0.720 | 0.6704 | 419. |
| 3 | 4 | 3.856 | 0.158 | 122.95 | −19.92 | −92. | −1.000 | 0.5374 | 387. |
| 3 | 3 | 4.114 | 0.162 | 116.31 | −12.74 | −115. | −1.000 | 0.1872 | 362. |
| 4 | 7 | 3.153 | 0.153 | 171.18 | — | — | — | — | — |
| 4 | 6 | 3.372 | 0.153 | 164.38 | 2.83 | 85. | 0.970 | 0.6954 | 452. |
| 4 | 5 | 3.606 | 0.158 | 131.13 | −21.83 | −95. | −1.000 | 0.5745 | 417. |
| 4 | 4 | 3.856 | 0.166 | 123.34 | −19.53 | −127. | −1.000 | 0.1996 | 388. |
| 5 | 8 | 2.949 | 0.152 | 181.72 | — | — | — | — | — |
| 5 | 7 | 3.153 | 0.151 | 173.82 | 2.64 | 91. | 0.941 | 0.6950 | 489. |
| 5 | 6 | 3.372 | 0.157 | 143.81 | −17.74 | −76. | −0.800 | 0.5896 | 450. |
| 5 | 5 | 3.606 | 0.169 | 131.60 | −21.36 | −140. | −1.000 | 0.2119 | 418. |
| 6 | 9 | 2.758 | 0.152 | 192.74 | — | — | — | — | — |
| 6 | 8 | 2.949 | 0.149 | 184.01 | 2.29 | 102. | 0.911 | 0.6818 | 528. |
| 6 | 7 | 3.153 | 0.157 | 157.29 | −13.89 | −53. | −0.594 | 0.5974 | 486. |
| 6 | 6 | 3.372 | 0.173 | 140.71 | −20.84 | −151. | −1.000 | 0.2206 | 451. |
| 7 | 10 | 2.595 | 0.152 | 202.67 | — | — | — | — | — |
| 7 | 9 | 2.758 | 0.148 | 194.77 | 2.03 | 129. | 0.970 | 0.6586 | 568. |
| 7 | 8 | 2.949 | 0.156 | 170.53 | −11.18 | −31. | −0.421 | 0.6083 | 525. |
| 7 | 7 | 3.153 | 0.177 | 150.31 | −20.88 | −162. | −1.000 | 0.2294 | 487. |
| 8 | 11 | 2.492 | 0.152 | 208.70 | — | — | — | — | — |
| 8 | 10 | 2.595 | 0.147 | 204.30 | 1.63 | 140. | 0.880 | 0.5939 | 606. |
| 8 | 9 | 2.758 | 0.155 | 186.83 | −5.91 | 20. | −0.058 | 0.5946 | 566. |
| 8 | 8 | 2.949 | 0.180 | 160.85 | −20.87 | −173. | −1.000 | 0.2380 | 525. |

As reflected in the data of Example I-B, at least one mill stand, acting on the upstream extremity (tail end) of the tubing, is exerting a maximum retarding force upon the tubing, consistent with avoiding significant slippage (i.e., a Pull Factor of −1.000). In addition, at least one of the three active (in terms of speed variation from steady-state) mill stands is driven to exert less than maximum pulling or retarding effectiveness, in order to achieve a desired balance of pulling and retarding forces.

It will be noted in the Example I-B that, when the tail end of the tube is at mill stands, 5, 6, 7 or 8, there are two mill stands exerting less than maximum pulling or retarding effectiveness, even though the indicated Stretch Factor is significantly less than the maximum allowable. In these instances, the limiting condition is the thickness of the tubing wall, which has been reduced to desired specifications (for that stage of the process) of approximately 0.152 inches. Thus, as one of the guiding principles of the process of the invention, selected mill stands may be driven to achieve force balancing, rather than maximum pull effectiveness even in the absence of maximum Stretch Factor conditions, where the desired wall thickness is realized.

EXAMPLE II-A

Example II-A is a rolling schedule for the head end rolling of heavy wall tubing, having a maximum Stretch Factor of 0.65.

EXAMPLE II-A

HEAD END ROLLING, HEAVY WALL TUBING
MAXIMUM STRETCH FACTOR = 0.65

| Head End At Stand NO. | Condition At Stand NO. | Average Tube O.D. (Inches) | Wall Thickness (Inches) | RPM | Delta RPM From Steady State | Total H.P. | Pull Factor | Stretch Factor | Velocity Leaving (FPM) |
|---|---|---|---|---|---|---|---|---|---|
| 1 | 1 | 4.631 | 0.656 | 57.18 | 0.00 | 34. | 0.229 | 0.0000 | 145. |
| 2 | 1 | 4.631 | 0.653 | 48.33 | −8.85 | −134. | −0.976 | 0.1443 | 147. |
| 2 | 2 | 4.372 | 0.668 | 62.19 | 0.00 | 261. | 1.000 | 0.1439 | 155. |
| 3 | 1 | 4.631 | 0.653 | 51.53 | −5.65 | −148. | −1.000 | 0.1469 | 157. |
| 3 | 2 | 4.372 | 0.660 | 64.24 | +2.05 | 69. | 0.168 | 0.3021 | 167. |
| 3 | 3 | 4.114 | 0.680 | 69.17 | 0.00 | 315. | 1.000 | 0.1552 | 177. |
| 4 | 1 | 4.631 | 0.653 | 53.65 | −3.52 | −155. | −1.000 | 0.1469 | 1640 |
| 4 | 2 | 4.372 | 0.655 | 59.95 | 2.24 | −107. | −0.682 | 0.4212 | 175. |
| 4 | 3 | 4.114 | 0.660 | 73.50 | +4.33 | 233. | 1.000 | 0.4410 | 188. |
| 4 | 4 | 3.856 | 0.693 | 76.35 | 0.00 | 379. | 1.000 | 0.1688 | 200. |
| 5 | 1 | 4.631 | 0.653 | 54.02 | −3.15 | −156. | −1.000 | 0.1469 | 165. |
| 5 | 2 | 4.372 | 0.653 | 57.31 | −4.88 | −164. | −1.000 | 0.4582 | 176. |
| 5 | 3 | 4.114 | 0.648 | 74.13 | +4.97 | 102. | 0.599 | 0.5992 | 191. |
| 5 | 4 | 3.856 | 0.658 | 78.96 | +2.61 | 256. | 1.000 | 0.4688 | 207. |
| 5 | 5 | 3.606 | 0.704 | 82.59 | 0.00 | 433. | 1.000 | 0.1809 | 222. |
| 6 | 1 | 4.631 | 0.653 | 53.56 | −3.61 | −154. | −1.000 | 0.1469 | 163. |
| 6 | 2 | 4.372 | 0.653 | 56.83 | −5.36 | −163. | −1.000 | 0.4582 | 175. |
| 6 | 3 | 4.114 | 0.644 | 72.25 | +3.09 | 43. | 0.291 | 0.6364 | 190. |
| 6 | 4 | 3.856 | 0.638 | 78.56 | +2.22 | 104. | 0.597 | 0.6256 | 208. |
| 6 | 5 | 3.606 | 0.655 | 84.24 | +1.65 | 270. | 1.000 | 0.4956 | 266. |
| 6 | 6 | 3.372 | 0.714 | 88.61 | 0.00 | 480. | 1.000 | 0.1935 | 244. |
| 7 | 1 | 4.631 | 0.653 | 53.11 | −4.07 | −153. | −1.000 | 0.1469 | 162. |
| 7 | 2 | 4.372 | 0.653 | 56.34 | −5.85 | −161. | −1.000 | 0.4582 | 173. |
| 7 | 3 | 4.114 | 0.644 | 71.63 | +2.47 | 42. | 0.291 | 0.6364 | 188. |
| 7 | 4 | 3.856 | 0.633 | 77.38 | +1.03 | 68. | 0.436 | 0.6500 | 206. |
| 7 | 5 | 3.606 | 0.627 | 83.36 | +0.77 | 89. | 0.495 | 0.6413 | 227. |

EXAMPLE II-A-continued

| Head End At Stand NO. | Condition At Stand NO. | Average Tube O.D. (Inches) | HEAD END ROLLING, HEAVY WALL TUBING MAXIMUM STRETCH FACTOR = 0.65 Wall Thickness (Inches) | RPM | Delta RPM From Steady State | Total H.P. | Pull Factor | Stretch Factor | Velocity Leaving (FPM) |
|---|---|---|---|---|---|---|---|---|---|
| 7 | 6 | 3.372 | 0.649 | 90.21 | +1.60 | 279. | 1.000 | 0.5227 | 248. |
| 7 | 7 | 3.153 | 0.722 | 95.50 | 0.00 | 532. | 1.000 | 0.2065 | 268. |
| 8 | 1 | 4.631 | 0.653 | 52.69 | −4.48 | −152. | −1.000 | 0.1469 | 161. |
| 8 | 2 | 4.372 | 0.653 | 55.91 | −6.28 | −160. | −1.000 | 0.4582 | 172. |
| 8 | 3 | 4.114 | 0.644 | 71.08 | +1.91 | 42. | 0.291 | 0.6364 | 187. |
| 8 | 4 | 3.856 | 0.633 | 76.78 | +0.43 | 67. | 0.436 | 0.6500 | 205. |
| 8 | 5 | 3.606 | 0.621 | 82.48 | −0.11 | 74. | 0.431 | 0.6500 | 225. |
| 8 | 6 | 3.372 | 0.614 | 88.83 | +0.22 | 78. | 0.413 | 0.6501 | 248. |
| 8 | 7 | 3.153 | 0.640 | 96.93 | +1.43 | 279. | 0.960 | 0.5448 | 272. |
| 8 | 8 | 2.949 | 0.727 | 103.25 | 0.00 | 586. | 1.000 | 0.2198 | 296. |

In observing the data of Example II-A, with particular reference to the Pull Factor column, it will be noted that in all circumstances where there are two or more mill stands acting on the tubing, at least one (at the downstream extremity) is driven to provide maximum pulling force and at least another (at the upstream end) is driven to provide maximum retarding force. In any case where there are three or more variable speed mill stands acting on the tubing, at least one is driven to provide an overall balance of pulling and retarding forces. This is reflected in the cases where the head end is located at mill stands 3, 4 and 5. In any case where the Stretch Factor of 0.65 is approached, as where the head end is at mill stands 6, 7 and 8, more than one mill stand is used to provide a balance of pulling and retarding forces, distributed in such a way that the maximum Stretch Factor is not exceeded at any position.

EXAMPLE II-B

In Example II-B, data is shown which reflects the rolling schedule for the tail end of the same tubing involved in the procedure of Example II-A.

the tubing at any moment at a speed different from the steady-state speed. This is a progressing sequence of mill stands, as will be understood, initially constituting mill stands 2–4 and ultimately progressing to mill stands 8–10. In all instances, the upstream-most mill stand is driven to exert maximum retarding effectiveness on the tubing. With the heavier wall tubing, the maximum Stretch Factor is approached rapidly in at least one mill stand, in each phase of the rolling progression. Accordingly, in each instance of the rolling schedule of Example II-B, two of the mill stands are driven to provide the desired balance of forces and limitation of Stretch Factor, rather than to provide maximum pulling or retarding effectiveness.

Examples II-A and II-B form the basis for the schematic and graphic illustrations of FIGS. 1–22, as will be evident upon careful comparison of the illustrations with the tabular data.

The process of the invention provides for a highly optimized basis for controlling variable speed stands of a stretch reducing mill, in order to minimize crop end losses at the tail end and head end sections. Particularly

EXAMPLE II-B

| Tail End At Stand NO. | Condition At Stand NO. | Average Tube O.D. (Inches) | TAIL END ROLLING, HEAVY WALL TUBING MAXIMUM STRETCH FACTOR = 0.65 Wall Thickness (Inches) | RPM | Delta RPM From Steady State | Total H.P. | Pull Factor | Stretch Factor | Velocity Leaving (FPM) |
|---|---|---|---|---|---|---|---|---|---|
| 2 | 5 | 3.606 | 0.643 | 82.59 | — | — | — | — | — |
| 2 | 4 | 3.856 | 0.648 | 78.46 | 2.11 | 133. | 0.690 | 0.6161 | 207. |
| 2 | 3 | 4.114 | 0.655 | 64.20 | −4.97 | −102. | −0.656 | 0.5287 | 189. |
| 2 | 2 | 4.372 | 0.664 | 56.95 | −5.24 | −201. | −1.000 | 0.2016 | 175. |
| 3 | 6 | 3.372 | 0.634 | 88.61 | — | — | — | — | — |
| 3 | 5 | 3.606 | 0.638 | 83.78 | 1.19 | 146. | 0.662 | 0.6168 | 227. |
| 3 | 4 | 3.856 | 0.650 | 71.04 | −5.31 | −63. | −0.436 | 0.5470 | 206. |
| 3 | 3 | 4.114 | 0.674 | 60.96 | −8.20 | −223. | −1.000 | 0.2177 | 190. |
| 4 | 7 | 3.153 | 0.624 | 95.50 | — | — | — | — | — |
| 4 | 6 | 3.372 | 0.627 | 89.76 | 1.15 | 157. | 0.627 | 0.6174 | 249. |
| 4 | 5 | 3.606 | 0.642 | 78.34 | −4.24 | −20. | −0.232 | 0.5672 | 226. |
| 4 | 4 | 3.856 | 0.683 | 65.69 | −10.66 | −244. | −1.000 | 0.2345 | 206. |
| 5 | 8 | 2.949 | 0.615 | 103.25 | — | — | — | — | — |
| 5 | 7 | 3.153 | 0.616 | 96.57 | 1.07 | 175. | 0.609 | 0.6156 | 273. |
| 5 | 6 | 3.372 | 0.633 | 85.89 | −2.72 | 22. | −0.055 | 0.5889 | 248. |
| 5 | 5 | 3.606 | 0.691 | 71.10 | −11.48 | −266. | −1.000 | 0.2515 | 266. |
| 6 | 9 | 2.758 | 0.606 | 111.81 | — | — | — | — | — |
| 6 | 8 | 2.949 | 0.604 | 104.27 | 1.02 | 209. | 0.629 | 0.6067 | 300. |
| 6 | 7 | 3.153 | 0.622 | 93.78 | −1.72 | 61. | 0.088 | 0.6075 | 273. |
| 6 | 6 | 3.372 | 0.698 | 77.15 | −11.47 | −283. | −1.000 | 0.2648 | 248. |
| 7 | 10 | 2.595 | 0.600 | 120.14 | — | — | — | — | — |
| 7 | 9 | 2.758 | 0.594 | 112.90 | 1.09 | 270. | 0.692 | 0.5871 | 331. |
| 7 | 8 | 2.949 | 0.609 | 102.26 | −0.99 | 103. | 0.226 | 0.6274 | 300. |
| 7 | 7 | 3.153 | 0.702 | 83.83 | −11.67 | −297. | −1.000 | 0.2784 | 271. |
| 8 | 11 | 2.492 | 0.598 | 125.72 | — | — | — | — | — |
| 8 | 10 | 2.595 | 0.585 | 121.39 | 1.25 | 335. | 0.825 | 0.5551 | 360. |
| 8 | 9 | 2.758 | 0.595 | 111.36 | −0.45 | 146. | 0.362 | 0.6486 | 330. |
| 8 | 8 | 2.949 | 0.704 | 91.11 | −12.14 | −306. | −1.000 | 0.2923 | 298. |

In the case of Example II-B, as in the case of Example I-B, there are three mill stands acting on the tail end of with seamless tubing, which necessarily is produced in finite length, reduction in crop end loss percentages can represent significant savings, indeed, in the overall production operations of a tubing manufacturer.

In its basic principles, the procedure of the present invention involves the variable speed control of a predetermined number of mill stands (all of them if desired) such that, when the head end or tail end section of the tubing is passing through that section of the mill various mill stands are accelerated and/or decelerated pursurant to significant limiting conditions, in order to maximize the effectiveness of the rolling operation on the end sections of the tubing. Although the specific procedures for head end rolling and tail end rolling differ, because of rather fundamental differences in the relationship of the tubing to the mill at the different ends, the limiting factors are generally applicable in both instances. For the head end rolling sequence, for example, whenever more than two of the controllable mill stands are engaging the tube, at least the upstream-most and the downstream-most are operating with maximum force effectiveness, one retarding and the other pulling. In the case of the tail end section, only the upstream mill stand, typically, is acting with maximum force (retarding) effectiveness, because the entire series of downstream mill stands is acting on the tubing and their combined effect is felt at the tail end section during the tail end rolling sequence.

In both the head end and tail end rolling procedures, where more than two controllable mill stands engage the tubing, at least one of them is driven at less than maximum force effectiveness, at a speed calculated to balance the pulling and retarding forces acting on the tubing. Where a limiting condition is reached, more than one mill stand is controlled to achieve a balance of pulling and retarding forces while at the same time maintaining the process within the limiting condition. In most cases, particularly with respect to head end rolling procedures, the limiting condition is the maximum Stretch Factor which has been established for the particular metallurgical and physical characteristics of the tubing being processed. In head end rolling schedules, as long as the maximum Stretch Factor is not approached, only a single mill stand may be controlled for balancing of forces, and the other speed controlled mill stands may be driven to provide maximum force effectiveness, either pulling or retarding. When Stretch Factor limits are approached, two or more adjacent variable speed mill stands are controlled to provide a distribution of forces, providing a balance of pulling and retarding forces without excessive pulling or retarding at any location, in terms of Stretch Factor. With tail end rolling procedures, minimum wall thickness levels may be achieved without approaching the Stretch Factor limits, in which case the wall thickness itself becomes a limiting condition and additional ones of the active variable speed mill stands are controlled at less than maximum force effectiveness, so that the limiting condition is not exceeded.

It should be understood of course that the specific examples and illustrations herein provided are intended only to be representative of the broader principles of the invention. Accordingly, reference should be made to the following appended claims in determining the full scope of the invention.

I claim:

1. A process for the stretch reducing rolling of tubular stock of finite length in a multiple stand rolling mill in which at least a plurality of mill stands at the upstream end of the mill are of variable speed, which comprises a. driving said mill stands at predetermined steady-start speeds during rolling of central portions of said finite length of tubing, and b. during rolling of at least one end region of the finite length of tubing, variably controlling the speeds of said upstream plurality of mill stands, whereby, 1. one or more upstream mill stands are driven at less than steady-start speed to exert a maximum restraining force on said tubing while avoiding significant slippage,
2. one or more downstream mill stands are driven at greater than steady-start speed to exert a pulling force on said tubing while avoiding significant slippage, and
3. where necessary, one or more intermediate mill stands are driven at controlled speeds, less than steady-start speeds, to maintain the stretch factor of the tubing in the immediate region of said intermediate mill stands, below a predetermined maximum.

2. The process of clam 1, further characterized by a. during rolling of the head end region of said length of tubing, driving one or more downstream mill stands to exert maximum pulling force on said tubing, and b. driving one or more intermediate mill stands at speeds to achieve a substantial equilibrium of pulling forces on opposite sides.

3. The process of claim 1, further characterized by a. during at least portions of said process, driving a sufficient plurality of intermediate mill stands at speeds to achieve force equilibrium at a level to maintain the tubing stretch factor at each such intermediate mill stand below a predetermined maximum level.

4. A process for the stretch reducing rolling of the head end of tubular stock of finite length, in a multiple stand rolling mill in which at least a plurality of mill stands at the upstream end of the mill are of variable speed, which comprises a. upon passage of the head end extremity through the first speed controlled mill stand commencing to run said first mill stand at a speed below steady-state speed, b. upon passage of the head end extremity through successive subsequent speed controlled mill stands, initially running said mill stands successively at speeds greater than steady-state speed and thereafter controllably changing the successive mill stand speeds to steady-state speeds, c. said vaiable speed mill stands being controlled such that, during at least a portion of the head end rolling sequence, maximum restraining force is being exerted by at least one upstream mill stand and maximum pulling force is being exerted by at least one downstream mill stand, and d. at least one intermediate mill stand, between said upstream and downstream mill stands, being controlled to establish substantial equilibrium of pulling forces on opposite sides thereof while maintaining the stretch factor of the tubing wall below a predetermined maximum.

5. The process of claim 4, further characterized by a. said mill stands normally being operated at predetermined steady-state speeds, b. the first variable speed mill stand being decelerated from its steady-state speed upon passage therethrough of the head end extremity of the tubing and subsequently controllably accelerated to steady-state speed, and c. at least certain of the downstream variable speed mill stands being initially accelerated upon passage therethrough of the head end extremity and subsequently decelerated to steady-state speed for rolling of the main body of the tube.

6. The process of claim 5, further characterized by a. the second variable speed mill stand being initially accelerated from its steady-state speed, upon passage therethrough of the head end extremity, then decelerated below its steady-state speed upon passage of the head end extremity through the next mill stand.

7. A process for the stretch reducing rolling of the tail end portion of tubular stock of finite length in a multiple stand rolling mill in which at least a plurality of mill stands at the upstream end of the mill are of variable speed, which comprises a. initially driving said mill stands at predetermined steady-state speeds, b. upon entry of the tail end section into the upstream mill stands, initially successively accelerating certain of said upstream mill stands from steady-state speeds, while decelerating mill stands upstream thereof, and thereafter decelerating the accelerated mill stands as successive mill stands downstream are accelerated, c. the variable speed mill stand which is acting at any time on the tail end extremity of the tubing section being controlled to exert maximum restraining force on the tubing without significant slippage.

8. A process for the stretch reducing rolling of the head end of tubular stock of finite length, in a multiple stand rolling mill in which at least a plurality of mill stands at the upstream end of the mill are of variable speed, which comprises a. initially operating the mill stands substantially at steady-state speeds, b. advancing a tube section into the entry end of the mill, c. progressively engaging the head end extremity of the tube section in successive mill stands operating substantially at steady-state speed, d. as the head portion of said tube section progresses into said mill, applying substantially maximum retardation to regions of the head portion rearward of the head extremity, and e. during times when said head portion is engaged simultaneously by three or more mill stands, operating one or more intermediate such mill stands at speeds effective to achieve substantial equilibrium of pulling forces on opposite sides of any such intermediate mill stands.

9. A stretch reducing process according to claim 8, further characterized by a. there being a predetermined maximum stretch factor for a given tube section, and b. the number of intermediate mill stands, between mill stands of maximum pulling force and mill stands of maximum retardation, being sufficient to prevent said maximum stretch factor being significantly exceeded in any region.

10. A process for the stretch reducing rolling of the head end of tubular stock of finite length, in a multiple stand rolling mill in which at least a plurality of mill stands at the upstream end of the mill are of variable speed, which comprises a. progressively engaging said head end by said upstream mill stands in succession, b. while said head end is engaged by two or more such mill stands, causing at least one upstream mill stand and at least one downstream mill stand to exert maximum retarding and maximum pulling effectiveness, respectively, on said head end without significant slippage, c. while said head end is engaged by three or more mill stands, causing at least one intermediate such mill stand to exert less than maximum force effectiveness and in a direction to achieve a substantial balance the pulling and retardating forces acting on said head end, and d. while said head end is engaged by four or more of said mill stands, causing more than one intermediate such mill stands to exert less than maximum force effectiveness in any instance where the stretch factor at an intermediate mill stand tends to exceed a predetermined maximum.

11. A process for the stretch reducing of the tail end of tubular stock of finite length, in a multiple stand rolling mill, in which at least a plurality of mill stands at the upstream end of the mill are of variable speed, which comprises a. initially driving said variable speed mill stands at steady-state speed, b. upon entry of the tail end section into the upstream mill stands, initially controlling the mill stand engaging the end section farthest upstream to provide maximum retarding force effectiveness, and c. controlling one or more variable speed mill stands downstream of the last mentioned mill stand to provide one of (i) maximum pulling force effectiveness, (ii) a lesser force effectiveness to avoid exceeding a predetermined stretch factor, (iii) a still lesser force effectiveness to avoid reducing the wall thickness below scheduled minimum for the mill stand location.

12. The process of claim 11, further characterized by a. a substantial plurality of mill stands being of variable speed control, b. a substantially lesser plurality of at least three such mill stands being controlled to act on said tail end section at any moment at other than steady-state speed, c. said lesser plurality of mill stands progressively changing as said tail end section proceeds through said substantial plurality of mill stands, whereby the actively effective lesser plurality moves along with the tail end section.

* * * * *